United States Patent [19]

Martignago

[11] Patent Number: 5,067,258

[45] Date of Patent: Nov. 26, 1991

[54] FLEXIBILITY ADJUSTER DEVICE, PARTICULARLY FOR SKI BOOTS

[75] Inventor: Pietro Martignago, Montebelluna, Italy

[73] Assignee: Nordica S.p.A., Montebelluna, Italy

[21] Appl. No.: 548,339

[22] Filed: Jul. 5, 1990

[30] Foreign Application Priority Data

Jul. 31, 1989 [IT] Italy ..... 82572 A/89

[51] Int. Cl.[5] ..... A43B 11/00; A43B 5/04

[52] U.S. Cl. ..... 36/117; 36/119; 36/121

[58] Field of Search ..... 36/117, 118, 119, 120, 36/121

[56] References Cited

U.S. PATENT DOCUMENTS

| | | | |
|---|---|---|---|
| 3,657,827 | 4/1972 | Rieker | 36/117 |
| 3,868,783 | 3/1975 | Caporicci | 36/120 |
| 4,073,073 | 2/1978 | Seidel | 36/121 |
| 4,078,322 | 3/1978 | Dalebout | 36/121 |
| 4,193,215 | 3/1980 | Hensler | 36/117 |
| 4,510,703 | 4/1985 | Eiteljorg | 36/117 |
| 4,577,421 | 3/1986 | Sartor | 36/117 |
| 4,615,128 | 10/1986 | Borsoi | 36/120 |

FOREIGN PATENT DOCUMENTS

| | | | |
|---|---|---|---|
| 0081042 | 6/1983 | European Pat. Off. | 36/117 |
| 3116839 | 2/1982 | Fed. Rep. of Germany | 36/117 |
| 3319749 | 12/1983 | Fed. Rep. of Germany | 36/117 |

*Primary Examiner*—Paul T. Sewell
*Assistant Examiner*—M. D. Paterson
*Attorney, Agent, or Firm*—Guido Modiano; Albert Josif

[57] ABSTRACT

In a ski boot having at least one quarter associated with a shell, the adjuster device includes a locking means for selecting the mutual sliding between two flaps which can partially overlap one another and are provided rearward to the shell. The device therefore allows, by locking the sliding of the flaps in different positions, to limit the flexing of the quarter and therefore adjust the flexibility of the boot.

15 Claims, 2 Drawing Sheets

FLEXIBILITY ADJUSTER DEVICE, PARTICULARLY FOR SKI BOOTS

BACKGROUND OF THE INVENTION

The present invention relates to a flexibility adjuster device particularly usable in ski boots composed of a shell with which at least one quarter is associated.

Several devices are currently known for adjusting the flexibility of the boot, which are nevertheless structurally very complicated and difficult to operate for the skier.

Devices are known for example which are located outside the boot in its rear portion and allow to adjust the flexibility of the quarter by means of adapted resilient members which can be pre-loaded by the skier.

A disadvantage of these devices is that of their size that physically and aesthetically encumber the boot.

As a partial solution to this disadvantage, this same Applicant filed an Italian patent application, No. 82538 A/87, disclosing a device for adjusting the flexing stroke and/or the inclination of ski boots, the peculiarity whereof consisting in that it comprises a knob which is rotatably associated at the back of the quarter, and operated by the skier. The knob has a threaded axial seat with which a complementarily threaded stem is associated, said stem interacting with the shell at the other end.

Depending on whether said end is directly connected to the shell or spaced therefrom, it is furthermore possible to adjust the inclination of the quarter with respect to the shell.

The flexibility of said boot is thus limited by limiting the play between the shell and the quarter.

Though this solution is undoubtedly valid, it is not as reliable as wanted, since it may sometimes jam, and it furthermore causes pressure points at the heel.

SUMMARY OF THE INVENTION

The aim of the present invention is therefore to eliminate the disadvantages of the known art described above by providing a device which allows the skier to limit the flexibility of the boot to the required degree in a rapid and simple manner.

Within the scope of the above described aim, an important object is to provide a device which is structurally simple and compact and does not substantially alter the aesthetics of the boot.

Another object is to provide a device which allows to also select the inclination of the quarter with respect to the shell.

A further object is to provide a small size device which can also be easily manufactured industrially.

Not least object is to provide a device which associates with the preceding characteristics that of being safe and reliable in use.

This aim, these objects and others which will become apparent hereinafter are achieved by a flexibility adjuster device, particularly for ski boots having at least one quarter associated with a shell, characterized in that it comprises a locking means operated by the skier for selecting the mutual sliding between at least two overlapping flaps provided rearward to said shell.

BRIEF DESCRIPTION OF THE DRAWINGS

Further characteristics and advantages of the invention will become apparent from the detailed description of some particular but not exclusive embodiments, illustrated only by way of non-limitative example in the accompanying drawings, wherein.

DESCRIPTION OF THE PREFERRED EMBODIMENTS

Figure 1:
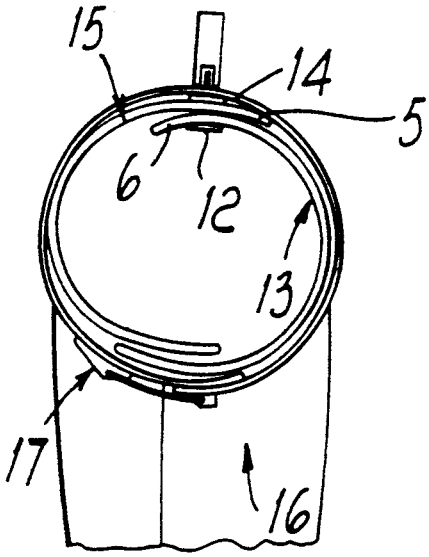
FIG. 1 is a partially broken top view of a boot according to the invention.
Figure 2:
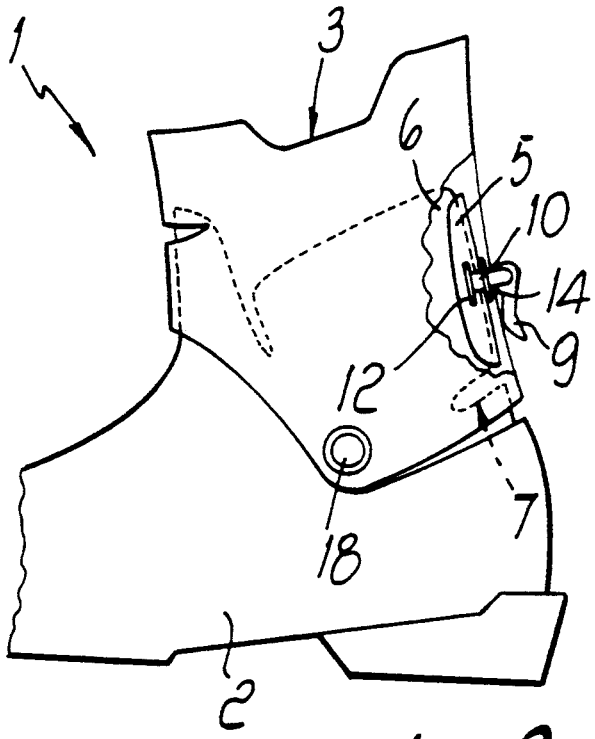
FIG. 2 is a partially sectional side view of the ski boot of FIG. 1.
Figure 3:
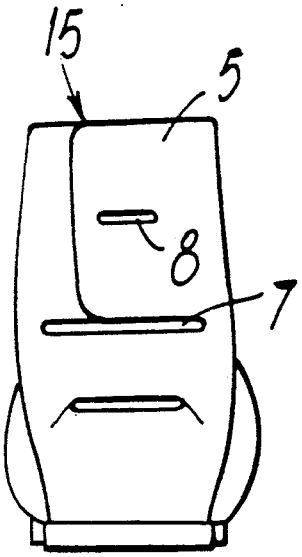
FIG. 3 is a schematic exploded rear view of the overlapping flaps of the shell of the ski boot.
Figure 4:
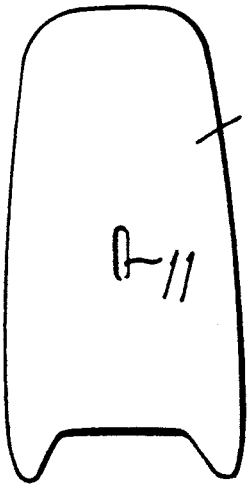
FIG. 4 is a rear view of the quarter associable with the shell.

With reference to the above figures, the reference numeral 1 indicates a ski boot which is constituted by at least one quarter, indicated by 3, associated with a shell 2. The shell has an upper portion 2a which, as can be seen in FIG. 2, is enveloped by the quarter 3.

The shell 2 has, at its rear region 4 and at its upper portion 29, a first flap 5 and a second flap 6 which partially overlap one another.

Said first and second flaps partially affect the longitudinal extension of the shell 2 and a depression 7 is formed transversely on said shell below said flaps.

A first slot 8 is provided at said first flap 5 and at said second flap 6, transversely to said flaps and at the same region, and defines a seat for a locking means which selects the mutual sliding between said first and second flaps.

Said locking means is in fact constituted by a lever 9 which is external to the quarter 3 and can be operated by the skier. A cam-shaped end of the lever is pivoted at the end of a threaded stem 10 which protrudes externally to said quarter 3 through a second slot 11 provided longitudinally thereto at the underlying first slot 8.

Said threaded stem 10 has, at its other end, a fixed head 12 which abuts at the inner lateral surface 13 of the second flap 6 which is adjacent to said first slot 8.

A complementarily threaded plate 14 is furthermore associated with the threaded stem 10 and can be locked at the outer lateral surface 15 of the first flap 5.

The quarter 3 is open in the front region 16, and a closure member 17 is provided, such as a lever which interacts with a traction element, adapted to close said front region of said quarter.

The operation of the device is therefore as follows: once the quarter 3 has been closed by means of the closure member 17 the skier can, by gripping the lever 9, rotate said lever to lock the sliding of the first flap 5 with respect to the second flap 6 which occurs during the forward flexing of said quarter 3 because of the interaction between the latter and the shell 2.

During flexing, the first and second flaps would in fact tend to be spaced apart; instead, by locking the first and second flaps at the required point of the slots 8, it is possible to limit the forward flexing of the quarter and therefore adjust its flexibility.

The skier can naturally act on the lever 9 so as to not lock the plate 14 onto the outer lateral surface 15 of the first flap 5, so as to ensure the maximum flexibility of the boot; vice versa, the locking means may lock the shell 2 and the quarter 3, by virtue of the cam-like configuration of the end of the lever 9 pivoted to the threaded stem 10, so as to select the inclination of the boot with a rigid quarter.

The configuration of the second slot 11 is adapted to allow the rotation of the quarter 3 with respect to the pivoting studs 18 relative to the shell 2 during flexing.

The configuration of the first slot instead allows sliding between the first and second flaps.

It has thus been observed that the invention has achieved the intended aim and objects, a device having been provided which allows the skier to adjust the degree of flexibility of the boot in a very rapid and easy manner.

The device is furthermore structurally very simple and compact and thus does not substantially alter the aesthetics of the boot; its small size and lower number of components, together with its constructive simplicity, makes the device easily manufactured industrially.

The device furthermore allows to also select the inclination of the quarter with respect to the shell.

The device is naturally susceptible to numerous modifications and variations, all of which are within the same inventive scope.

Figure 5:
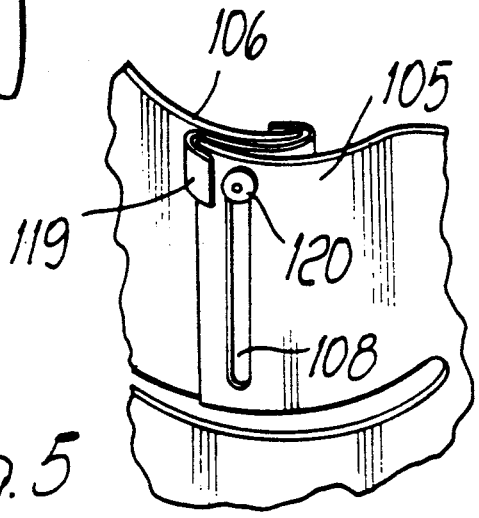
FIG. 5 is an isometric partial rear view of a ski boot according to a second aspect of the invention.
Figure 6:
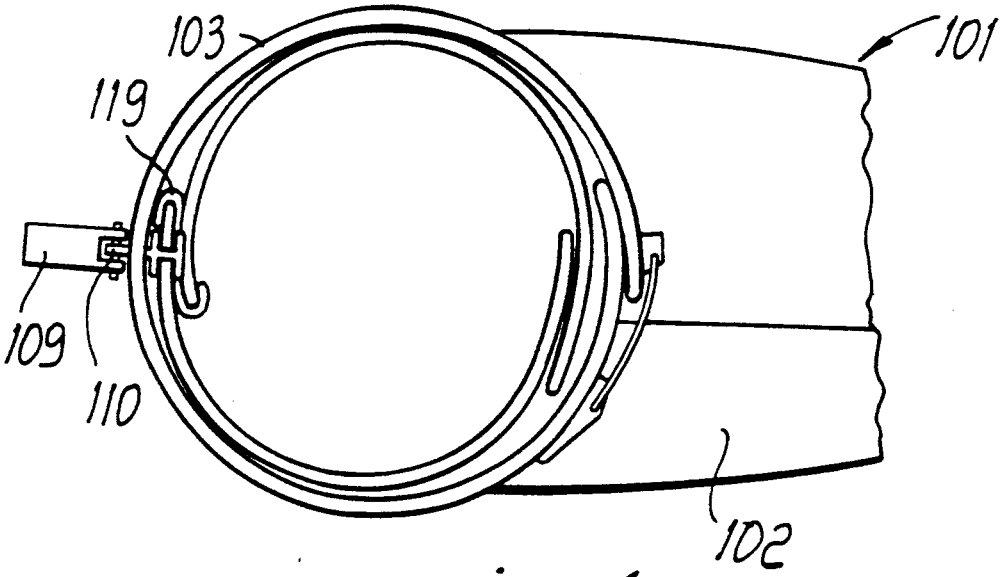
FIG. 6 is a view, similar to that of FIG. 1, of the ski boot of FIG. 5.
Figure 7:
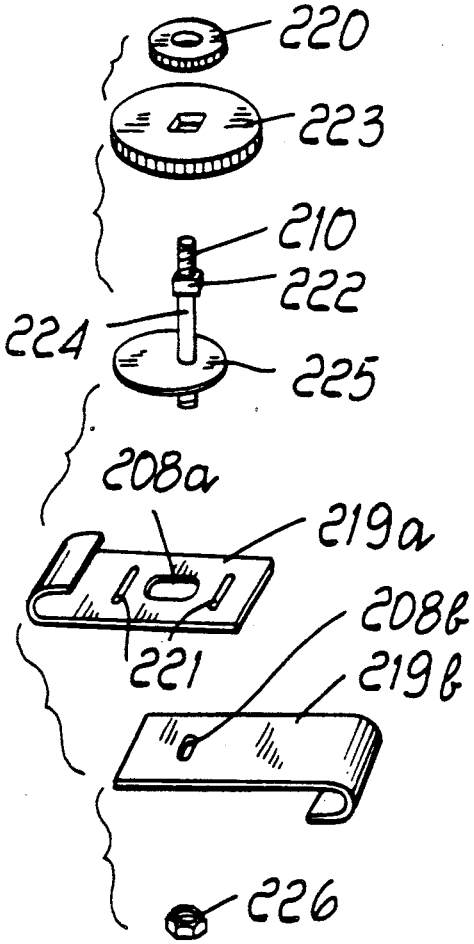
FIG. 7 is an exploded view of a further embodiment of the device.

Thus, for example, FIGS. 5 and 6 illustrate a second embodiment for a boot 101 in which the ends of the first flap 105 and of the second flap 106 are mutually interconnected by means of an adapted S-shaped plate 119.

In this case the locking means is again constituted by a lever 109, as in FIG. 6, or by a washer 120, as shown in FIG. 5, respectively pivoted to the threaded stem 110 or screwed thereat.

In this case a slot 108 is provided on each of said first and second flaps and on the quarter 103 and is arranged longitudinally thereto at the same axis.

In this embodiment, since the quarter transmits the flexing stresses to the shell 102 initially on the upper end thereof, by placing the plate 119 at said end and then locking the lever 109, or the washer 120, with the threaded stem arranged at the upper end of the slot 108, it is possible to prevent the overlapping of the first and second flaps, stiffening the shell and therefore the entire structure during bending.

Vice versa, by placing the plate 119 at the lower end of the slot 108, the upper end of the first flap partially overlaps the upper end of the second flap, achieving maximum flexibility for the boot.

Advantageously, according to a further embodiment of the invention, a first plate **219*a* and a second plate 219*b* have each a fold so as to grip the ends of the first and second flaps on which a first slot 208*a* and a second slot 208*b*** are respectively provided and arranged respectively longitudinally and transversely to said first and second plates.

A pair of parallel raised portions 221 are furthermore provided on the first plate **219*a* in a region adjacent to the first slot 208*a*** and are arranged transversely to said first plate.

The threaded stem 210 has a first end which interacts with a complementarily threaded washer 220 and further has a squared portion 222 at which a knob 223 provided with a complementarily square shaped axial seat is arranged.

A pivot 224 is arranged beyond said square portion 222 and a disk 225, equal in diameter to the interspace between said pair of raised portions 221, is eccentrically rigidly associated with said pivot.

The pivot 224 further has a threaded end which protrudes beyond said disk and passes at the first slot **208*a* and at the second slot 208*b* so as to be locked at a nut 226**.

In this case, the operation of the device is as follows. Upon a rotation imparted to the pivot 224 by means of the knob 223 the disk 225 moves the first plate **219*a* along the first slot 208*a*, whereas the washer 220** allows to mutually lock the first and second plates, the second flap and the quarter.

By sliding the first and second plates on each other it is thus possible to adjust the overlap between the first and second flaps provided on the shell.

Figure 8:
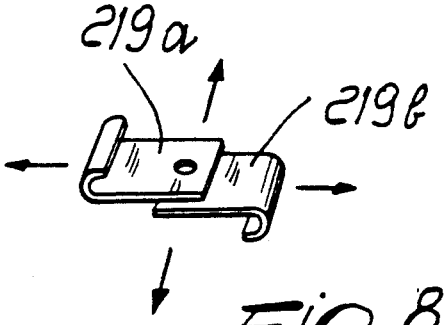
FIGS. 8 and 9 are isometric views of two different embodiments of the plate of the device.

FIG. 8 thus illustrates the movements which can be imparted to the first plate **219*a* and to the second plate 219*b*** and which can occur according to an axis which is longitudinal or transverse to the quarter.

Figure 9:
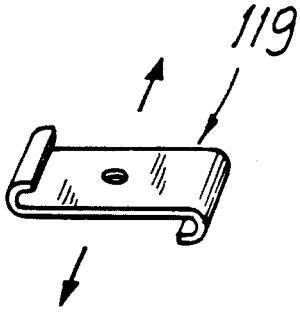

FIG. 9 instead illustrates the plate 119 related to the first illustrated embodiment and stresses the possibility of a movement exclusively according to the axis which is longitudinal to the quarter.

The materials as well as the dimensions which constitute the individual components of the device may naturally be the most pertinent according to the specific requirements.

I claim:

1. Flexibility adjuster device, particularly for ski boots having at least one quarter associated with a shell, comprising a locking means operated by the skier for selecting the mutual sliding between at least two overlapping flaps provided rearward to said shell, said shell having, at a rear region, a first and second flaps which mutually partially overlap, said first and second flaps partially affecting the longitudinal extension of said quarter, a depression being provided below said flaps transversely to said shell, wherein the terminal ends of said first and second flaps are mutually interconnected by means of an adapted S-shaped plate.

2. Device according to claim 1, wherein said locking means allows to mutually lock said shell and said at least one quarter so as to allow to vary the inclination of said at least one quarter.

3. Device according to claim 1, wherein a slot is provided on each of said first and second flaps and on said quarter and is arranged longitudinally thereto and at the same axis.

4. Device according to claim 1, wherein said S-shaped plate comprises a first plate and a second plate, both of which have a hook-like folded end so as to grip the ends of said first and second flaps, and on which a first slot and a second slot are respectively defined and are arranged respectively longitudinally and transversely to said first and second plates.

5. Device according to claim 1, wherein said S-shaped plate comprises a first plate and a second plate, both of which have a hook-like folded end so as to grip the ends of said first and second flaps, and on which a first slot and a second slot are respectively defined and are arranged respectively longitudinally and transversely to said first and second plates, a pair of raised portions being provided on said first plate in a region adjacent to said first slot, said raised portions being mutually parallel and arranged transversely to said first plate.

6. Device according to claim 1, wherein said S-shaped plate comprises a first plate and a second plate, both of which have a hook-like folded end so as to grip the ends of said first and second flaps, and on which a first slot and a second slot are respectively defined and are arranged respectively longitudinally and transversely to said first and second plates, a pair of raised portions being provided on said first plate in a region adjacent to said first slot, said raised portions being mutually parallel and arranged transversely to said first plate, a threaded stem having a first end interacting with a complimentarily threaded washer and subsequently having a squared portion at which a knob is arranged, said knob having a complimentarily shaped axial seat, a pivot being provided beyond said squared portion, a disk equal in diameter to the interspace between said pair of raised portions being eccentrically rigidly associated with said pivot, said pivot having a threaded end which protrudes beyond said disk and passes at said first and second slots to be locked to an adapted nut.

7. Flexibility adjuster device, particularly for ski boots which comprise a shell and at least one quarter associated with said shell, said shell defining an upper region being at least partially enveloped by said quarter, said shell being provided at said upper portion thereof with at least a first flap and at least a second flap, said first flap and said second flap mutually overlapping and being mutually slidable relative to each other, said flexibility adjuster device comprising locking means actuatable externally to said ski boot for locking the relative position of said first and second flaps.

8. Device according to claim 7, wherein said first and second flaps of said shell are provided with a first slot means and wherein said locking means comprise a threaded stem means accommodated through said first slot means.

9. Device according to claim 7, wherein said first and second flaps of said shell are provided with a first slot means and wherein said locking means comprise a threaded stem means accommodated through said first slot means, said first slot means being a transverse first slot means extending transversely to an upwardly extending extent defined by said shell, said quarter being provided with a second slot means extending substantially parallel to said upwardly extending extent, said threaded stem means being accommodated through said first slot means and said second slot means, said locking means further comprising a fixed head being provided at an inner end of said threaded stem means inside said shell, and a threaded plate interposed between said first and second flaps and said quarter through which said threaded stem is screwed, thereby a tightening screwing actuation of said threaded stem providing a locking of the relative position of said first and second flaps, and an untightening actuation of said threaded stem allowing free relative movement of said flaps.

10. Device according to claim 9, wherein said quarter is pivoted at pivoting means to said shell to allow a rotation of said quarter relative to said shell during flexing, means for locking the relative position of said quarter relative to said shell being furthermore provided which are constituted by a cam-lever means pivoted to an outer end of said threaded stem externally to said quarter.

11. Device according to claim 7, wherein said first and second flaps of said shell are provided with a first slot means and wherein said locking means comprise a threaded stem means accommodated through said first slot means, said first slot means being an upwardly extending first slot means extending substantially parallel to an upwardly extending extent defined by said shell, said threaded stem being lockably positionable in a plurality of positions along said first slot means, thereby a flexing adjustment of said upper portion of said shell being provided.

12. Device according to claim 11, wherein the terminal ends of said first flap and said second flap are mutually interconnected by means of an S-shaped plate means.

13. Device according to claim 11, wherein the terminal ends of said first flap and said second flap are mutually interconnected by means of an S-shaped plate means, said S-shaped plate means comprising a first plate and a second plate for allowing adjustment of the longitudinal extension, in the direction transverse to said upwardly extending extent, of said S-shaped plate means.

14. Flexibility adjuster device, particularly for ski boots which comprise a shell and at least one quarter associated with said shell, said shell defining a heel region and an upper region being at least partially enveloped by said quarter, said shell being provided at said upper portion thereof with at least a first flap and at least a second flap, said first flap and said second flap mutually overlapping and being mutually slidable relative to each other, said flexibility adjuster device comprising locking means actuatable externally to said ski boot for locking the relative position of said first and second flaps, said quarter being pivoted at pivoting means to said shell to allow a rotation of said quarter relative to said shell during flexing, said flexibility adjuster device further comprising means for locking the relative position between said quarter and said first and said second flaps.

15. Device according to claim 14, wherein said first and second flaps of said shell are arranged at said heel region of said shell and are provided with a first slot means and wherein said locking means comprise a threaded stem means accommodated through said first slot means, said quarter being provided with a second slot means extending substantially parallel to said upwardly extending extent, said threaded stem means being accommodated through said first slot means and said second slot means, said locking means further comprising a fixed head being provided at an inner end of said threaded stem means inside said shell, and a threaded plate interposed between said first and second flaps and said quarter through which said threaded stem is screwed, thereby a tightening screwing actuation of said threaded stem providing a locking of the relative position of said first and second flaps, and an untightening actuation of said threaded stem allowing free relative movement of said flaps, said means for locking the relative position between said quarter and said first and said second flaps being constituted by a cam-lever means pivoted to an outer end of said threaded stem externally to said quarter.

* * * * *